US006105504A

United States Patent [19]

Ayres et al.

[11] Patent Number: 6,105,504

[45] Date of Patent: Aug. 22, 2000

[54] CONTACT EXPLODER

[75] Inventors: Dwight T. Ayres, Boalsburg; Carroll L. Key, Jr., State College; Miles T. Pigott, State College; George F. Wislicenus, State College, all of Pa.

[73] Assignee: The United States of America as represented by the Secretary of the Navy, Washington, D.C.

[21] Appl. No.: 04/839,798

[22] Filed: Jun. 30, 1969

[51] Int. Cl.[7] ..... F42C 1/00; F42C 11/06; F42C 14/04

[52] U.S. Cl. ..... 102/220; 102/216; 114/20.1

[58] Field of Search ..... 102/17, 70.2, 273, 102/266, 218, 220, 216, 399, 421, 293; 114/20.1, 21.3

[56] References Cited

U.S. PATENT DOCUMENTS

| | | | |
|---|---|---|---|
| 2,887,056 | 5/1959 | Perret | 102/20.2 |
| 2,961,961 | 11/1960 | Kendall et al. | 114/20.1 |
| 3,106,160 | 10/1963 | Harnau et al. | 102/20.2 |
| 3,111,089 | 11/1963 | Dodson | 102/20.2 |
| 3,111,901 | 11/1963 | Dodson et al. | 102/20.2 |
| 3,158,705 | 11/1964 | Bliss | 102/20.2 X |
| 3,372,642 | 3/1968 | Brothers | 102/20.2 |
| 3,690,259 | 9/1972 | Piazza et al. | 102/220 |

*Primary Examiner*—Charles Jordan
*Assistant Examiner*—Christopher K. Montgomery
*Attorney, Agent, or Firm*—Harvey Fendelman; John Stan; Eric James Whitesell

[57] ABSTRACT

Actuating circuitry which may be used with a contact exploder, useful on a torpedo, for example, which is sensitive not only to direct hits but also to abrasive damage or sea water exposure caused by grazing contact, but insensitive to changes in its velocity or momentum or unwanted environmental background, such as shock, vibration and electromagnetic field variation. The exploder includes a normally insulated and shielded wire which traverses that part of the surface of the missile which is most likely to make contact with a target. The wire is so connected into associated actuating circuitry that it will cause explosion if: (1) even grazing contact with a target causes removal of even a small amount of the insulation and shielding of the wire, which causes grounding of the circuitry at the wire; or (2) even grazing contact opens or breaks the wire at any point. The circuitry may include a "fail-safe" feature which prevents explosion in the event that the wire has inadvertently opened or shorted before the start of tactical operation.

10 Claims, 3 Drawing Sheets

NOTE 1. R25 = 1K FOR $V_1$ = +22.5 V
R25 = 3.9K FOR $V_1$ = +28 V
FOR R100 AND R101, SEE TEXT
ALL RESISTORS 1/2 W ± 10% EXCEPT R26

INVENTORS.
DWIGHT T. AYRES
CARROLL L. KEY, JR.
MILES T. PIGOTT
GEORGE F. WISLICENUS
BY ERVIN F. JOHNSTON
ATTORNEY.
JOHN STAN, AGENT.

CONTACT EXPLODER

The invention described herein may be manufactured and used by or for the Government of the United States of America for governmental purposes without the payment of any royalties thereon or therefor.

The present devices used as contact exploders are sensitive to changes in the velocity or momentum of the torpedo and, as such, are subject to a variety of unwanted background environments, including shock and vibration. Present devices are also sensitive to countermeasures such as countermining. Furthermore, present devices are relatively insensitive to grazing contacts, being more sensitive to direct hits.

The present contact exploder devices are of two kinds, both of which are subject to environmental accelerations or momentum changes and both of which fail to operate for grazing contacts. One type is the "ball switch," consisting of a small spherical mass which displaces against a spherical cap to make electrical contact. Either springs or permanent magnets are used to provide a restoring force. The other type is a piezoelectric accelerometer. The "ball switch" is in current use, and the accelerometer is being designed into future exploders.

Although such prior art devices have served the purpose, they have not proved entirely satisfactory under all conditions of service, one reason being that considerable difficulty has been experienced in determining the precise amount of acceleration which should actuate an explosion as distinguished from the normal acceleration experienced by the torpedo in traveling through the water.

The general purpose of this invention is to provide an actuating circuit for a contact exploder for a torpedo which embraces all of the advantages of the prior art and possesses none of the aforedescribed disadvantages. To attain this, the present invention contemplates a unique actuating circuit, with the result that the contact exploder is sensitive to abrasive damage or exposure to sea water as a result of even a grazing contact between a massive torpedo and a relatively immovable target, such as an ocean-going vessel, and to provide a detonation signal upon suffering such damage or exposure. Moreover, the contact exploder is insensitive to any other environmental change during normal torpedo operations, especially to changes in the velocity or momentum of the torpedo, considered as a rigid body. Furthermore, the contact exploder of this invention is insensitive to known countermeasures of all types.

In broad terms, the invention comprises an actuating circuit which may be used with a contact exploder, as in a torpedo. The actuating circuit includes a charging circuit with a charge-discharge capacitor and an insulated sensing conductor.

Means are provided, in the form of electronic circuitry, operatively connecting the sensing conductor to the charging circuit, for holding the charging circuit in a quiescent condition until the occurrence of at least one of the following:

(1) the insulated sensing conductor opens, (2) a portion of the insulation of the insulated sensing conductor is removed and the sensing conductor is shorted, specifically by immersion in and contact with seawater.

The contact exploder of this invention includes a normally insulated and shielded conductor which traverses the nose section of a torpedo, particularly that area of it which surrounds the transducer window. The conductor, which may be called a sensing conductor, is usually in the form of a wire but may be a flat strip, and is so connected into associated actuating circuitry that it will cause explosion if a grazing contact or a direct hit with a target causes removal of a small amount of the insulation and shielding of the wire, which causes grounding of the circuitry at the wire. The insulation is purposely made to be fairly easily removable, even by only a grazing contact. The contact exploder will also be actuated if a direct hit or grazing contact breaks the conductor at any point. The actuating circuitry may include a "fail-safe" feature which prevents explosion in the event that the wire had inadvertently opened or shorted before the start of a tactical operation. Where a "fail-safe" feature is lacking, a simple mechanical timer, which prevents the actuating circuit from firing a squib and thereby causing explosion until a predetermined time interval has expired, may be, and generally is, included. An appropriate place for the timer would be at the input to the actuating circuitry, between the power source and the actuating circuitry.

An object of the present invention is the provision of a contact exploder which is sensitive to either abrasive damage and resultant seawater exposure or breakage of the sensing conductor.

Another object is to provide a torpedo exploder which is insensitive to physical environmental changes, such as changes in the velocity or momentum of the torpedo.

A further object of the invention is the provision of a contact exploder which is insensitive to electromagnetic countermeasures.

Still another object of the invention is the provision of a "fail-safe" feature which ensures against premature explosion.

Yet another object of the invention is to provide a torpedo exploder which will detonate at all angles of grazing contact.

Other objects and many attendant advantages of this invention will be readily appreciated as the same becomes better understood by reference to the following detailed description, when considered in connecting with the accompanying drawings, in which like reference numerals designate like parts throughout the figures thereof and wherein.

Figure 1:
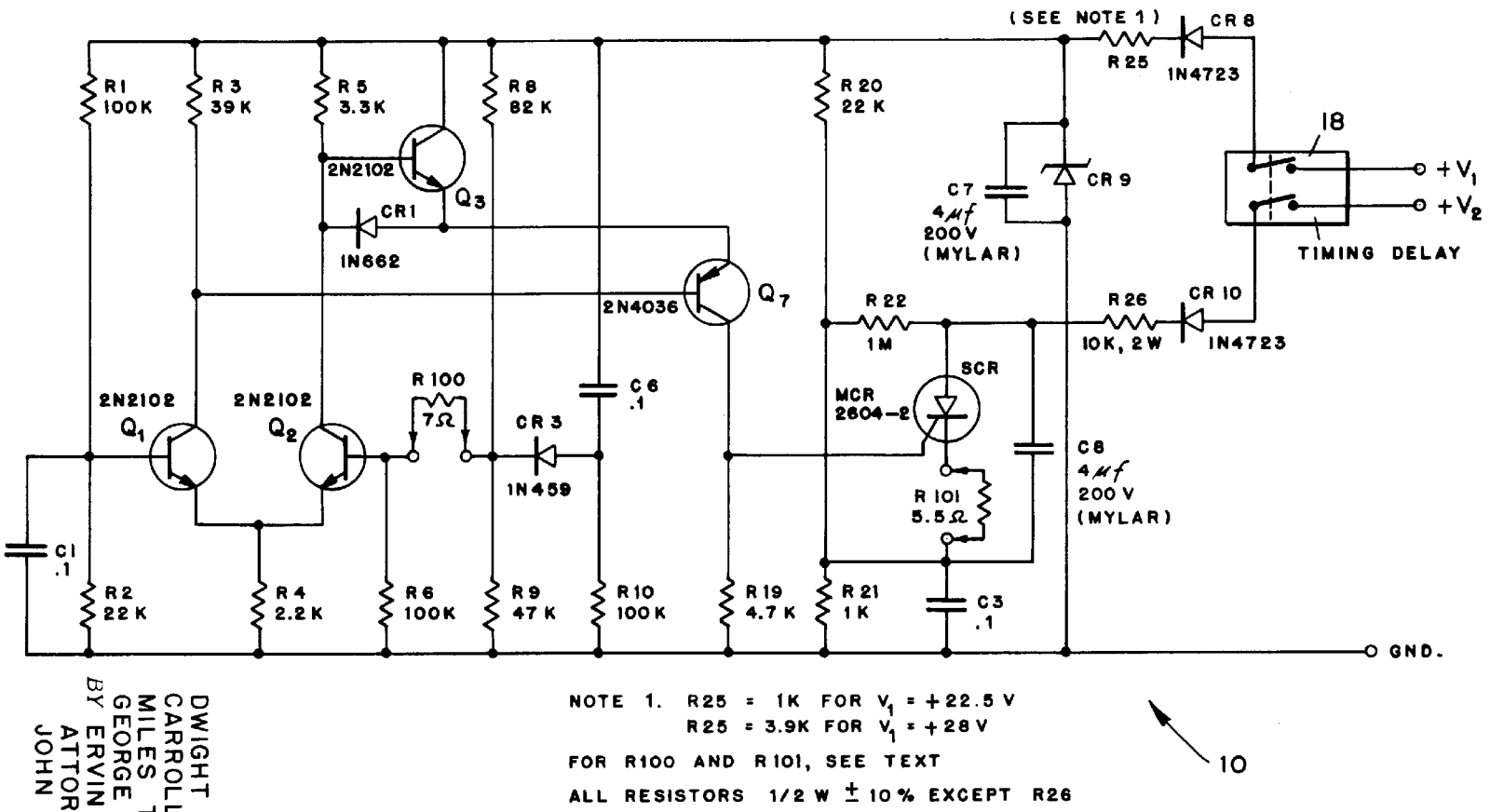
FIG. 1 is a schematic diagram of an actuating circuit without an electronic fail-safe feature, but having a mechanical timer to afford some protection.

Discussing now the figures in more detail, FIG. 1 is a schematic drawing of actuating circuit 10, not including an electronic "fail-safe" feature which would inactivate the circuit if initial operation indicates premature rupture or grounding of the sensing conductor R100. However, a timing delay 18 would generally be connected at the input voltage sources $V_1$ and $V_2$ to ensure safe operation should the sensing conductor R100 have accidentally shorted or grounded before the start of operation. The timer 18 prevents battery power from either $V_1$ or $V_2$ from being applied to the actuating circuitry until a certain interval of time has elapsed.

In the firing of a torpedo it is generally necessary to have some timing arrangement so that this exploder (as well as a possible influence exploder or other such device) would not be activated until the torpedo was in the water and had traveled a reasonably safe distance away from the firing vessel. It is assumed that no electrical power would be applied to this device until the torpedo had reached such a suitable "arm point." At this time, either a broken sensing conductor or one from which the insulation had been abraded to allow contact with the sea water, thereby causing grounding, would activate the fail-safe or abort circuit.

The battery supplying voltage $V_2$ is made separate from the battery supplying voltage $V_1$ so that voltage $V_2$ could be made considerably larger then $V_1$. The reason for this is that more energy can be stored in the charging capacitor C8 in FIG. 1, and C5 in FIG. 2, and ultimately delivered to the squib, without raising the working voltage of the transistors in the rest of the circuit. Voltage $V_1$ was selected to be a conservative value with respect to the manufacturer's rating of the transistors. This enhances reliability.

Figure 2:
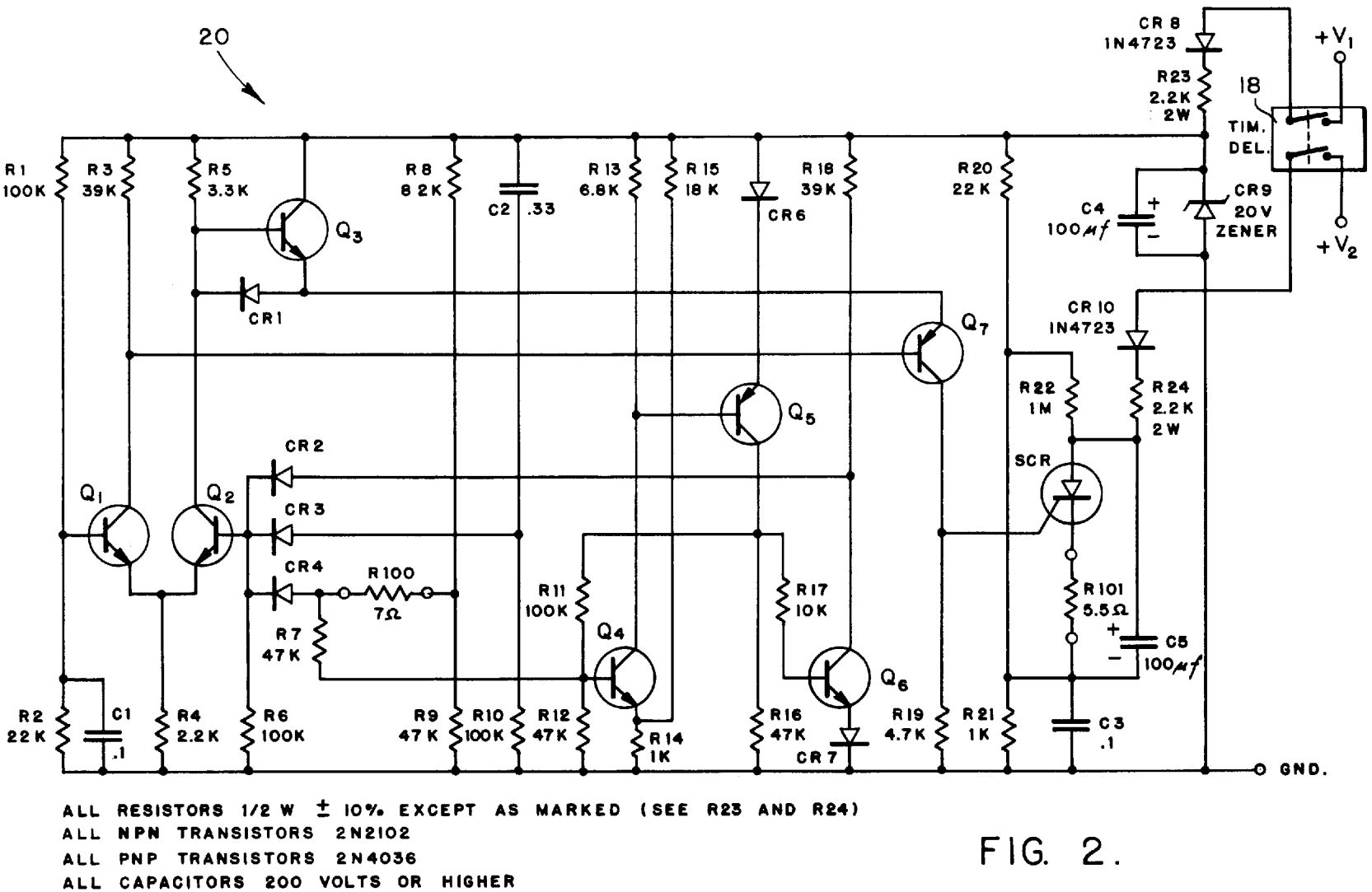
FIG. 2 is a schematic diagram of an actuating circuit including an electronic fail-safe feature.

If it were desired to operate from a single supply voltage, resistor R25 in FIG. 1 and resistor R23 in FIG. 2 could be made larger both in resistance value and wattage rating. This might prove somewhat wasteful of power, and might create some problem in excessive heat dissipation from these resistors. In this case, the timer 18 would have only one input and one output.

The purpose of the actuating circuit 10 shown in FIG. 1 is to produce an output pulse through R101, the squib detonating wire, when R100, the sensing conductor, is either opened or grounded after voltage V1 is applied. As will be explained in more detail in connection with FIGS. 3–6, sensing conductor R100 may open or short if either a grazing contact or direct hit is made by the torpedo. The operating ranges of resistors R100 and R101 are quite broad. In prototype models, R100 varied from 0.1 Ω to 500 Ω and R101 varied from 3 to 9 Ω. The values given on the drawings are the approximate geometric means of these values.

Most of the actuating circuitry shown in FIG. 1, as well as in FIG. 2, comprises the means operatively connecting the sensing conductor R100 to the charging circuit, including charge-discharge capacitor C8 and resistor R26.

Transistors Q1 and Q2 form a differential amplifier. Transistor Q1 is normally turned off with its base biased to +4.2V d-c, resistor R1 and resistor R2 forming the biasing network. Transistor Q2 is normally turned on, with a base voltage of +5.8V d-c developed across resistor R6. The bias of transistor Q2 is obtained from the voltage divider formed by resistors R8 and R9 and passes through the sensing conductor R100 to the base of transistor Q2. With transistor Q2 conducting and transistor Q1 turned off, the collector of transistor Q2 is negative with respect to the collector of transistor Q1, thereby applying a reverse polarity to transistor Q7, which may be called a pulse-forming transistor, thereby holding transistor Q7 in a non-conducting state.

When the sensing conductor R100 is either opened or grounded, transistor Q2 is turned off, since its base is connected to ground through resistor R6. Transistor Q1 will in turn become conducting. The polarity on transistor Q7 then causes a collector current to flow, and a positive pulse appears across resistor R19 and the trigger of the silicon-controlled rectifier SCR. This fires the SCR and the charge on capacitor C8 is dumped through the squib detonating wire R101. Diode CR1 and transistor Q3 serve to reduce the source impedance of resistor R5 by the gain of transistor Q3 and apply strong drive to the emitter of transistor Q7.

If the battery voltages $V_1$ or $V_2$ are changed significantly from the values shown in FIGS. 1 and 2, then the combination of the values of the charge-discharge capacitor, C8 in FIG. 1 and C5 in FIG. 2, and the charging resistor, R26 in FIG. 1 and R24 in FIG. 2, must be such that enough electrical energy is stored in that capacitor to ensure firing the squib.

Referring now to FIG. 2, transistors Q4, Q5 and Q6 serve as a fail-safe latch in case the sensing conductor R100 is shorted to ground or open prior to the application of voltage $V_1$. The operation of the latch is as follows. Capacitor C2, resistor R10, and diode CR3 apply the initial rise of voltage $V_1$ to the base of transistor Q2, turning it on for about a millisecond regardless of the state of the sensing conductor 100. Transistors Q4 and Q5 form a Schmitt trigger type of circuit, with positive d-c feedback through resistor R11. If positive drive is applied to the base of transistor Q4 through R7, transistors Q4 and Q5 will subsequently remain turned on due to the positive feedback even if the drive through resistor R7 is removed. If transistors Q4 and Q5 are turned on, drive is applied to transistor Q6, holding the collector of transistor Q6 negative and back-biasing diode CR2 for the entire subsequent operation of the circuit. However, if transistors Q4, Q5 and Q6 are never turned on due to the sensing conductor R100 being defective, resistor R18 and diode CR2 will hold transistor Q2 in the conducting state and no output pulse will appear.

Resistors R20 and R21 apply a small positive bias to the cathode of the silicon controlled rectifier SCR to insure against triggering until a strong positive pulse appears across resistor R19.

Capacitors C4 and C5 store sufficient energy to operate the circuit for a time duration of up to 0.2 sec after power is removed. The purpose of diodes CR8 and CR10 is to prevent discharge of capacitors C4 and C5, respectively, if voltages V1 and V2 drop below normal. The function of resistor R22 is to slowly discharge capacitor C5 if voltage V2 is removed, thereby disarming the exploder.

Capacitor C1 assists capacitor C2 in the function of assuring that, when power is initially applied, transistor Q1 comes up non-conducting and transistor Q2 conducting.

Figure 3:
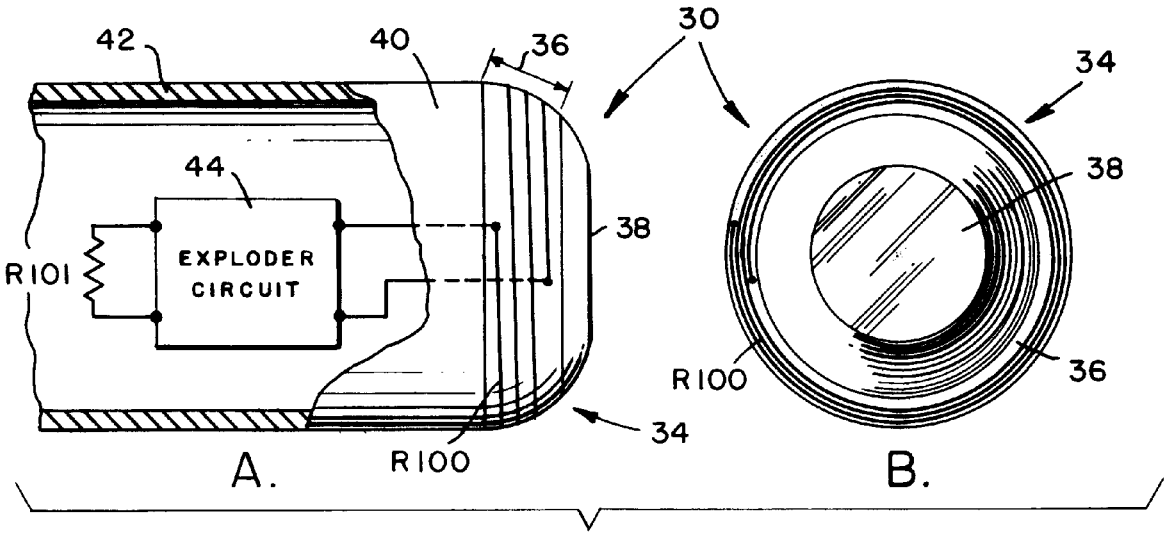
FIG. 3 is a view, partially cross-sectional and partially schematic, showing a helical winding of the sensing conductor whose shorting to ground or breakage actuates the contact exploder.

Referring now to the figures which show the physical construction of the key features of the invention, FIG. 3 depicts one general arrangement of the actuating or sensing conductor R100, its configuration and positioning on the nose 34 of the torpedo 30. The sensing conductor R100 is positioned on the forward end or nose 34 of the torpedo in the area 36 between the transducer window 38 and the cylindrical portion 40 of the torpedo wall 42. The conductor R100 is formed into the shape of a helix with a spacing of approximately one-half inch between adjacent elements. The entire helix is a resistor R100 of low value in a circuit, 10 in FIG. 1 or 20 in FIG. 2, whose function it is to provide a detonation signal to the exploder circuit 33 if either (1) the conductor R100 is broken or (2) exposed to sea water, thus becoming grounded. See FIGS. 1 and 2. Moreover, the circuit 20 in FIG. 2, will abort the operation if the integrity of the conductive strip or its insulator is found to be broken ab initio, that is, upon first energization. The leads from the helical sensing conductor R100 are passed through the wall 42 of the torpedo by a hermetic terminal (not shown), are connected to an exploder circuit 44, which, in turn, is connected to an explosive detonator circuit by means of resistor R101, the squib detonating wire.

Figure 4:
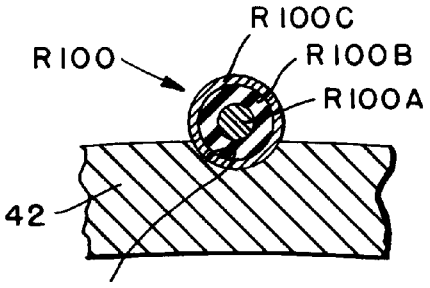
FIG. 4 shows a cross-sectional view of part of the nose of a torpedo, the view being taken perpendicularly to the axis of the sensing conductor.

FIG. 4 is a detailed cross-sectional view taken at right angles to the axis of the insulated conductor R100, showing the conductor itself R100A, the insulation R100B about it, both enclosed by shielding R100C. The insulated conductor R100 may be attached directly to the wall 42 of the torpedo, preferably in an external groove 46. The conductor R100A surrounded by insulation R100B and the electromagnetic shield R100C is positioned in the manner shown so that it be ruptured in the event of collision of even a grazing nature of the vehicle.

Figure 5:
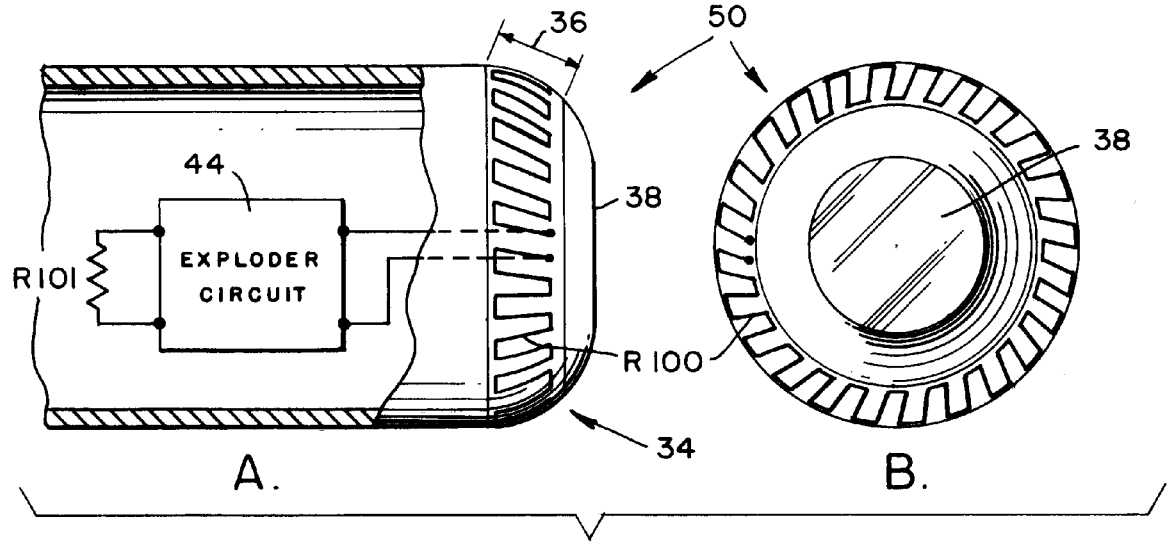
FIG. 5 shows another view, partly cross-sectional and partly schematic, which shows another configuration of the sensing conductor wound about the surface of the nose cone.

FIG. 5 is a view similar to that shown in FIG. 3, showing an embodiment 50 in which the sensing conductor R100 is in the form of a rectangular waveform rather than a helix. The area on the nose 34 of the torpedo within which the coil is wound is again designated by reference numeral 36.

Figure 6:
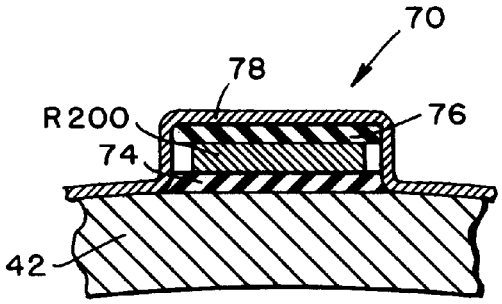
FIG. 6 is another cross-sectional view of part of the nose cone of the torpedo, again taken in a direction which is perpendicular to the axis of the sensing conductor, the sensing conductor being flat in this case.

FIG. 6 is another cross-sectional view showing an embodiment 70 taken at right angles to the axis of a sensing conductor R200, which is in the form of a conductive foil. A first insulating layer 74 is first placed upon the wall 42 of the torpedo, then the conductive foil or layer R200 next, then a second insulating layer 76, and finally, the assembly is covered with an electromagnetic shielding layer 78. The shielding layer 78 may cover the whole area designated 34 in FIGS. 3 and 5. Any of these layers R200, 74, 76 or 78, may be preformed, preassembled, or sprayed or stenciled in place.

Any other configuration which would cover the area 36 of the torpedo nose 34 between the transducer window 38 and the cylindrical wall 42 with a continuous conductor would perform the function of the conductor having the form of a helix or rectangular waveform equally well, provided any contact of at least one square inch would break the conductor. Any other circuit could be substituted for those shown in FIGS. 1 and 2 if the function of providing a pulse to resistor R101, the squib detonating wire, upon the grounding or rupture of sensing resistor R100 is maintained.

Obvious many modifications and variations of the present invention are possible in the light of the above teachings. It is therefore to be understood that within the scope of the appended claims the invention may be practiced otherwise than as specifically described.

What is claimed is:

1. An actuating circuit for a contact exploder comprising:

a charging circuit including a charge-discharge capacitor;

an insulated sensing conductor;

means operatively connecting the sensing conductor to the charging circuit for holding the charging circuit in a quiescent condition until the occurrence of at least one of the following:

(1) the insulated sensing conductor opens, (2) a portion of the insulation of the insulated sensing conductor is removed and the sensing conductor is shorted;

the charging circuit, which is adapted for connection to a direct-current power supply, comprising:

a differential amplifier, comprising two transistors whose emitters are connected together to a grounded resistor, and whose collectors are connected to the direct-current power supply;

one of the transistors, the first differential transistor, being based biased;

the other transistor, the second differential transistor, having a base which is connected to a grounded resistor and one end of the second conductor, the other end of the sensing conductor being connected to a grounded resistor;

a pulse-forming transistor, whose emitter is connected to the direct-current power supply, whose base is connected to the collector of the first differential transducer, and whose collector is connected to a grounded resistor;

a silicon-controlled rectifier (SCR), whose anode is connected to the direct-current power supply, whose gate is connected to the collector of the pulse-forming transistor, and whose cathode is connected to one end of a squib detonating wire, the other end of the squib being connected through an RC combination to ground, one end of the charge-discharge capacitor being connected to the anode of the SCR, the other end being connected to the junction of the squib and the RC combination;

the following sequence of events occurring if the sensing conductor is either opened or grounded, after a voltage had been applied to the charging circuit; the second differential transistor becomes nonconducting, the first differential transistor begins to conduct, causing collector current to flow in the pulse-forming transistor, which causes a positive pulse to appear at the gate of the silicon-controlled rectifier, forcing it to fire, thereby dumping the charge which had accumulated on the discharge capacitor through the squib detonating wire.

2. The actuating circuit of claim 1 wherein the insulated sensing conductor is mounted in a torpedo.

3. The actuating circuit of claim 2 wherein:

the sensing conductor open circuits when the torpedo collides with a target.

4. The actuating circuit of claim 2 wherein the sensing conductor short circuits when the torpedo collides with a target.

5. The actuating circuit of claim 1 wherein the insulated sensing conductor is an insulated wire.

6. The actuating circuit of claim 5 wherein the insulated wire has a helical shape.

7. The actuating circuit of claim 5 wherein the insulated wire has a substantially rectangular waveform shape.

8. The actuating circuit of claim 5 further comprising a squib detonating wire connected to the charging circuit.

9. The actuating circuit of claim 8 further comprising a timing delay circuit for preventing detonation of the squib until the passage of predetermined period of time.

10. The actuating circuit of claim 9 further comprising a fail-safe circuit to prevent detonation of the contact exploder before a predetermined time.

* * * * *